US007165285B1

(12) United States Patent
Hajianpour

(10) Patent No.: US 7,165,285 B1
(45) Date of Patent: Jan. 23, 2007

(54) APPLIANCE FOR APPLYING LOTION WITH A ROTATING PAD

(75) Inventor: Zoya Hajianpour, Coral Springs, FL (US)

(73) Assignee: Zoya, Inc., Sunrise, FL (US)

( * ) Notice: Subject to any disclaimer, the term of this patent is extended or adjusted under 35 U.S.C. 154(b) by 0 days.

(21) Appl. No.: 10/747,384

(22) Filed: Dec. 29, 2003

(51) Int. Cl.
*A47K 7/02* (2006.01)
*A46B 13/02* (2006.01)

(52) U.S. Cl. ..... 15/28; 15/22.1; 601/138; 601/114

(58) Field of Classification Search ..... 15/22.1, 15/28, 29, 97.1, 97.3, 210.1, 209.1; 601/114, 601/144, 137, 138
See application file for complete search history.

(56) References Cited

U.S. PATENT DOCUMENTS 3,027,585 A * 4/1962 Freedman et al. ..... 15/230.19
3,030,967 A 4/1962 Peyron
3,750,226 A * 8/1973 Morgan ..... 15/187
4,111,666 A * 9/1978 Kalbow ..... 51/295
4,203,431 A * 5/1980 Abura et al. ..... 601/6
4,483,636 A 11/1984 Meyer
4,512,053 A * 4/1985 Horak et al. ..... 15/28
4,724,563 A * 2/1988 Fry et al. ..... 15/28
4,962,562 A * 10/1990 Englund et al. ..... 15/230.16
5,353,461 A * 10/1994 Enriquez ..... 15/23
5,360,111 A 11/1994 Arispe
5,851,077 A 12/1998 Trejo
5,857,233 A * 1/1999 Wynn ..... 15/97.1
5,931,590 A 8/1999 Harris
6,006,761 A * 12/1999 Meledandri ..... 132/320
6,026,535 A * 2/2000 Lankowski ..... 15/209.1
6,058,542 A * 5/2000 Lo ..... 15/28
6,129,469 A 10/2000 Messer et al.
6,170,108 B1 * 1/2001 Knight ..... 15/29
D447,279 S 8/2001 Altobellis et al.
6,530,707 B1 3/2003 Byrne et al.
6,730,051 B1 * 5/2004 Lin ..... 601/112
6,732,394 B1 * 5/2004 Waterman ..... 15/97.1
6,799,346 B1 * 10/2004 Jeng et al. ..... 15/28
2003/0097724 A1 * 5/2003 Park ..... 15/23
2003/0208864 A1 * 11/2003 Kohler ..... 15/104.001

* cited by examiner

*Primary Examiner*—Gladys J P Corcoran
*Assistant Examiner*—Shay L. Karls
(74) *Attorney, Agent, or Firm*—Ronald V. Davidge

(57) ABSTRACT

An appliance for applying a lotion, such as a sunscreen, to the skin includes a housing, from which a soft pad extends, and a elongated handle. The pad, which includes a flat application surface, is rotated by a motor in the handle about an axis of rotation perpendicular to the flat application surface. The surface of the pad may be formed of a porous material or of a solid elastomeric material having a texture providing spaces for holding lotion.

6 Claims, 3 Drawing Sheets

APPLIANCE FOR APPLYING LOTION WITH A ROTATING PAD

BACKGROUND OF THE INVENTION

1. Field of the Invention

This invention relates to an appliance for applying a lotion to the skin, and more particularly to applying lotion, such as a sunscreen lotion, to the skin on a portion of a person's body that is difficult to access, allowing a person to apply sunscreen lotion to his or her own back.

2. Background of the Invention

The patent art includes a number of descriptions of devices including reservoirs for holding lotions, such as sunscreen products, and applicator pads, attached to elongated handles, in communication with the reservoirs, for application of the lotion to remote areas of the skin, such as a person's back. For example, U.S. Pat. No. 6,129,469 describes such a device including an elongated handle supporting a head with a flat applicator pad constructed of a sponge-like material. The head includes a reservoir that the user fills with the preferred tanning lotion, soap, or oil. A valve between a squeeze pump located at the end of the handle opposite the head allows the user to pressurize the reservoir, so that the lotion, soap, or oil is forced through exit apertures in the flat applicator pad. U.S. Pat. No. 4,483,636 describes such a device including a hollow, flexible handle with a removable cap at one end for adding lotion and with an ellipsoidal or spherical structure at the other end, which is disposed within a socket of a dispensing head. The dispensing head, which is hollow, includes a reservoir for the receipt of liquid through orifices and a flat or concave bottom application surface.

U.S. Pat. Nos. 5,931,590 and 6,530,707 describe versions of such devices in which a piston operated from the handle is used to provide pressure within the reservoir to cause lotion to be fed from the reservoir to the applicator head. In the device of U.S. Pat. No. 5,931,590, the applicator head includes an annular cylindrical sponge extending around a cylindrical reservoir having a number of holes through which the lotion is squeezed into the sponge. The device of U.S. Pat. No. 6,530,737 includes a flexible housing through which the piston is driven.

U.S. Pat. No. 5,851,077 describes a sunscreen lotion applicator including an applicator head member constructed in the form of a ball roll-on applicator, or alternatively as a cylindrical roller, or as a replaceable porous dauber that is covered with a chained cap. The applicator head connects with an elongated handle serving as a lotion container through a flexible bellows portion. The end of the handle opposite the applicator head includes a cap that is removed to fill the handle with lotion.

What is needed is an appliance for applying such fluids to the back without the inconvenient requirement that the fluids must first be poured into a reservoir within the appliance.

Other patents show disk-shaped sponge applicators attached to elongated handles. For example, U.S. Design Pat. No. D447,279 describes such a device having a handle that can be folded about a hinge mid-way along its length. U.S. Pat. No. 5,360,111 describes a compact holding a base plate to which a soft pad is attached, together with a collapsed telescoping handle, which is extended and removably attached to the base plate before using the pad to apply sunscreen lotion.

U.S. Pat. No. 3,030,967 describes a process for applying cosmetic material to the skin, with the process including bringing a portion of the material into contact with the skin, bringing an applicator into contact with the material without substantial pressure in a direction toward the skin surface, and moving the applicator back and forth with an alternating motion along a path substantially parallel to the surface of the skin at a frequency such as 120 Hz.

What is needed is an applicator using a simple motion, such as rotation of a disk driven by a battery-powered motor, for applying a sunscreen lotion rapidly to a relatively large area, such as a person's back, together with an elongated handle for reaching remote areas, and a process for applying the lotion first to the applicator, and then to the skin.

SUMMARY OF THE INVENTION

According to one aspect of the invention, an appliance is provided for applying lotion to the skin. The appliance includes a housing, a soft pad, an elongated handle, a motor, and a battery. The soft pad, which is mounted within the housing to rotate about an axis of rotation, includes a flat application surface. The flat application surface, which is outwardly disposed from the housing, extends perpendicularly to the direction of rotation. The motor drives the soft pad to rotate about the axis of rotation. The battery supplies electrical power to drive the motor.

Preferably, the appliance additionally includes an axle shaft mounted within the housing to rotate about the axis of rotation and a mounting plate attached to the soft pad. The axle shaft may then include a detent member held outward from the axle shaft to engage a groove within the mounting plate, so that the mounting plate is releasably attached to the axle shaft.

Preferably, the motor is mounted within the elongated handle, with the appliance additionally including a drive shaft, attached to the motor, extending through the handle from the motor into the housing. A worm gear attached to the drive shaft then engages a worm wheel attached to the axle shaft to rotate the axle shaft.

Preferably, the appliance additionally includes an actuator movable to turn the motor off and on, either by moving a battery holder away from contact terminals carrying current to the motor and into contact with the terminals, or by holding contacts in a circuit extending between a battery and the motor together and by allowing them to separate, interrupting the circuit.

The soft pad may include an outer portion composed of a porous material, such as an open cell elastomeric foam resin or a natural or synthetic sponge material. Alternately, the soft pad may include an outer portion composed of a solid elastomeric material, having an outer surface including a number of cavities for holding lotion or an outer surface including a number of bumps extending outward from an interstitial surface, allowing the interstitial surface to carry a layer of lotion.

BRIEF DESCRIPTION OF THE INVENTION

DETAILED DESCRIPTION OF THE INVENTION

Figure 1:
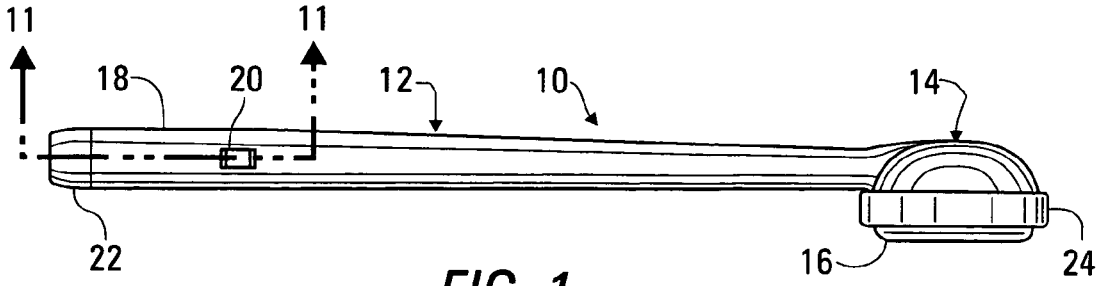
FIG. 1 is a right side elevation of an appliance built in accordance with the invention.
Figure 2:
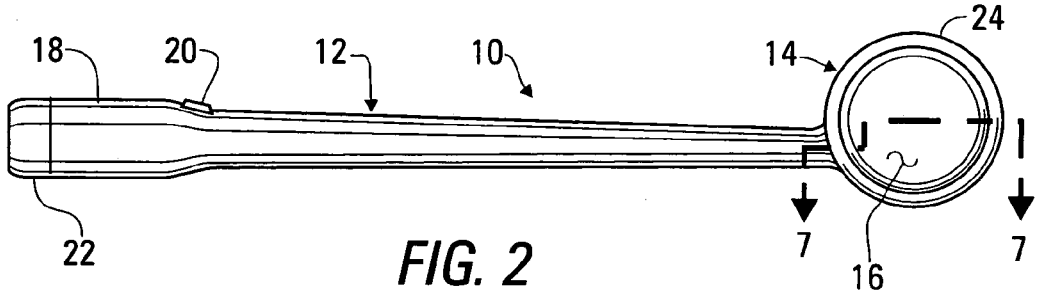
FIG. 2 is an bottom plan view of the appliance of FIG. 1.
Figure 3:
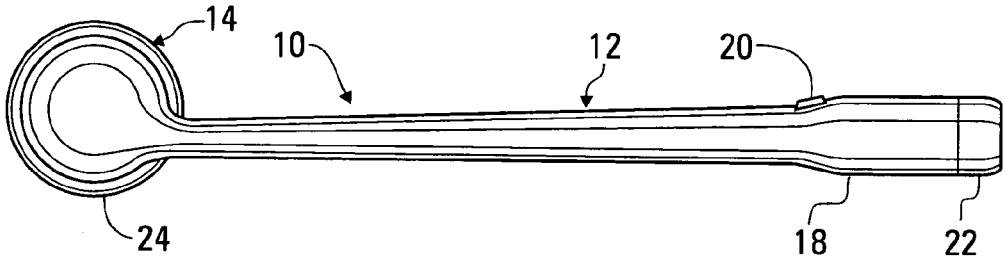
FIG. 3 is a plan view of the appliance of FIG. 1.
Figure 4:
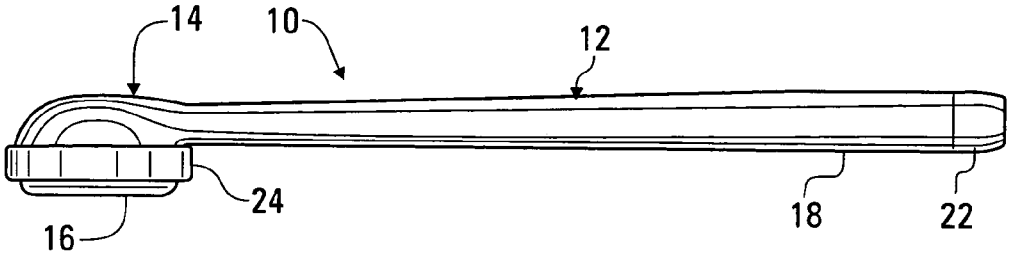
FIG. 4 is a left side elevation of the appliance of FIG. 1.
Figure 5:
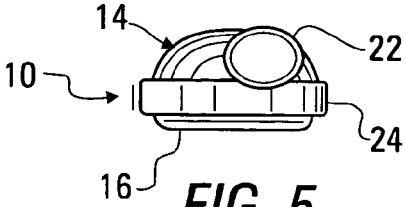
FIG. 5 is a proximal end view of the appliance of FIG. 1.
Figure 6:
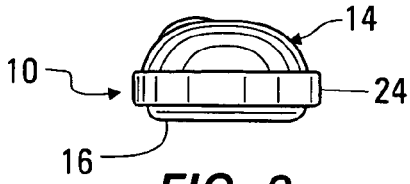
FIG. 6 is a distal end view of the appliance of FIG. 1.

The external features of an appliance 10 for applying a lotion, such as a sunscreen lotion, to a remote area of a person's body, such as the back, will now be discussed in reference to FIGS. 1–6. FIG. 1 is a right side elevation of the appliance 10, while FIG. 2 is a bottom plan view thereof, FIG. 3 is a plan view thereof, FIG. 4 is a left side elevation thereof, FIG. 5 is a proximal end view thereof, and FIG. 6 is a distal end view thereof.

The appliance 10 includes a handle portion 12 and an applicator head portion 14, which supports a rotating pad 16 used to apply lotion. The handle portion 12 is elongated to facilitate the use of the appliance 10 to apply lotion in hard to reach areas, and particularly so that a person can use the appliance 12 to apply lotion to his own back. The handle portion 12 includes an enlarged end 18 for gripping and a sliding actuator 20 for turning a motor causing rotation of the pad 16 off and on. The handle portion 12 additionally includes a battery holder 22, which is removable to provide for the replacement of batteries held within the handle portion 12. The applicator head portion 14 includes a pad mounting plate 24, which is removed with the pad 16.

Figure 7:
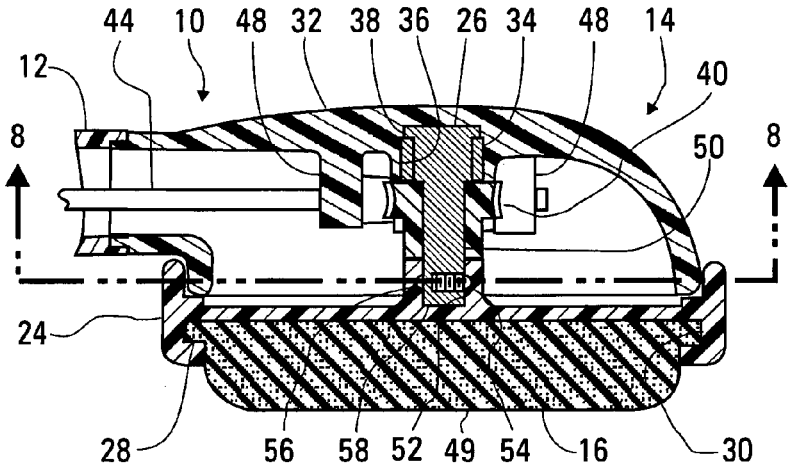
FIG. 7 is fragmentary cross-sectional elevation of the appliance of FIG. 1, taken as indicated by section line 7—7 in FIG. 2.
Figure 8:
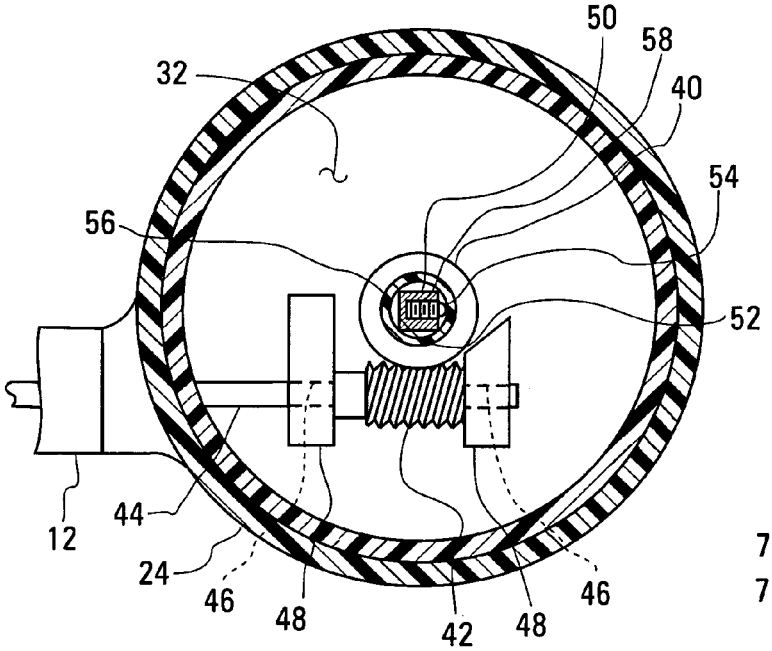
FIG. 8 is a fragmentary cross-sectional bottom plan view of the appliance of FIG. 1, taken as indicated by section line 8—8 in FIG. 7.

The mechanism within the applicator head portion 14 for driving the pad 16 in rotation will now be discussed in reference to FIGS. 7 and 8. FIG. 7 is a fragmentary cross-sectional elevation of the appliance 10, taken as indicated by section line 7—7 in FIG. 2, while FIG. 8 is a fragmentary cross-sectional bottom plan view of the appliance 10, taken as indicated by section lines 8—8 in FIG. 7.

The pad 16 is attached to the pad mounting plate 24, which is removably attached to an axle shaft 26. For example, a ridge 28 of the pad 16 s clamped within a groove 30 of the pad mounting plate 24. The pad 16 may also be adhesively attached to the pad mounting plate 24. The axle shaft 26 is rotatably mounted within a housing 32 of the applicator head portion 14 by means of a bearing 34 pressed into a hole 36 of the housing 32, along with the axle shaft 26. While rotational movement of the axle shaft 26 is permitted, axial movement of the shaft 26 is restricted by a flange 38 forming a part of the axle shaft 26. A worm wheel 40, attached to the axle shaft 26, driving the axle shaft in rotation through engagement with a worm 42 attached to a drive shaft 44. The drive shaft 44, which is rotatably held within a pair of holes 46 in blocks 48 forming portions of the housing 32. This arrangement provides for rotation of the pad 16 about an axis of rotation, which is the longitudinal axis at the center of the axle shaft 26, with the flat application surface 49 of the pad 16 extending perpendicularly from this axis of rotation. The handle portion 12 of the appliance 10 may be formed as a separate portion, which is attached to the housing 32, as shown in FIGS. 7 and 8, or the handle portion 12 may be formed as an integral part including the housing 32, as shown in FIGS. 1–6.

The axle shaft 26 includes a non-circular portion 50 that engages a mating hole 52 within the pad mounting plate 24. The pad mounting plate 24 is further held in place on the non-circular portion 50 by a detent sphere 54 that is held within a groove 56 in the pad mounting plate 24 by a spring (not shown) within a threaded fastener 58.

Figure 9:
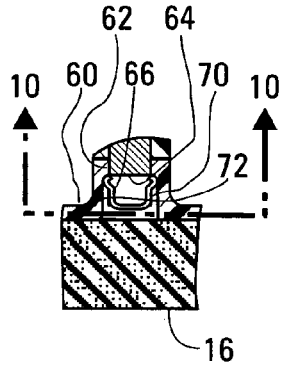
FIG. 9 is a fragmentary cross-sectional elevation of a version of the appliance of FIG. 1 having an alternative mechanism attaching a pad to an axle shaft.
Figure 10:
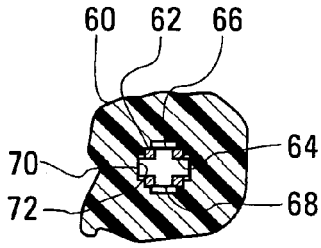
FIG. 10 is a fragmentary cross-sectional bottom plan view of the version of the appliance shown in FIG. 9, taken as indicated by section line 10—10 therein.

An alternative method for holding an alternative pad mounting plate 60 in place on an alternative non-circular portion 62 will now be discussed with reference being made to FIGS. 9 and 10. FIG. 9 is a fragmentary cross-sectional elevation of a central portion of the alternative pad mounting plate 60, being held to the alternative version non-circular portion 62, which includes a slot 64 at its lower end. FIG. 10 is a fragmentary bottom plan view thereof, taken as indicated by section line 10—10 in FIG. 9. The alternative pad mounting plate 60 is held in place on the non-circular portion 62 by means of a formed detent spring 66, which includes a pair of tabs 68 welded to the end of the non-circular portion 62. The formed detent spring 66 also includes a pair of spring leaves 70, which extend within slots 72 of the pad mounting plate 60. These spring leaves 70 must be deflected inward by the curved ends of the slots 72 to allow the removal of the pad mounting plate 60.

Figure 11:
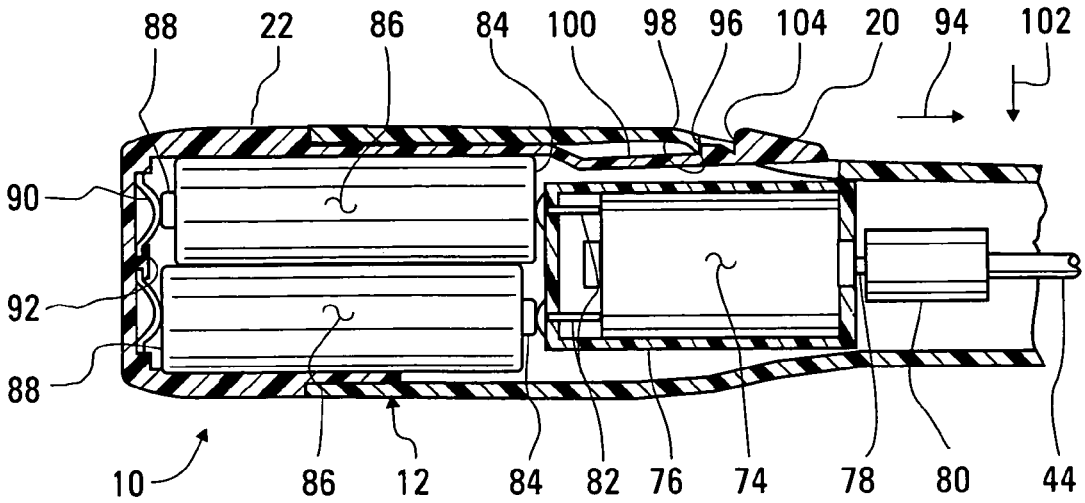
FIG. 11 is a fragmentary cross-sectional bottom plan view of the appliance of FIG. 1, taken as indicated by section line 11—11 therein to show structures associated with a motor and batteries therein.

FIG. 11 is fragmentary cross-sectional bottom plan view of the appliance 10, taken as indicated by section line 11—11 in FIG. 1 to show structures associated with a motor 74 used to drive the drive shaft 44 in rotation. The motor 74 is held within a motor housing 76, which is in turn held within the handle portion 12 of the appliance 10. The drive shaft 44 is fastened to the output shaft 78 of the motor 74 by means of a coupling 80. The motor 76 is electrically driven through a pair of contact terminals 82 that extend through the motor housing 76 to contact the proximal end terminals 84 of a pair of AA batteries 86. The electrical circuit is completed by connecting the distal end terminals 88 of the batteries 86 by means of a spring contact 90 fastened within the battery holder 22. For example, the spring contact 90 may be fastened in placed by heat forming a stud 92 extending through a hole within the spring contact 90 as a part of the battery holder 22.

The battery holder 22 is held inward, in the direction of arrow 94, by the engagement of a first latching surface 96 of the sliding actuator 20 within a slot surface 98 in the handle portion 12. The sliding actuator 20 is formed at the end of a flexible cantilever tab 100 extending inward as a part of the battery holder 22. With the battery holder 22 held inward in this way, electrical current flows through the batteries 86 and the motor 74, so that the drive shaft 44 is turned, rotating the soft pad 16 (shown in FIG. 7).

Electrical power to the motor 74 is turned off by depressing the sliding actuator 20, in the direction of arrow 102, so that the first latching surface 96 is moved out of engagement within the slot surface 98, and by then sliding the actuator 20 outward, opposite the direction of arrow 94, so that a second latching surface 104 of the sliding actuator 20 engages the slot surface 98. This outward movement of the sliding actuator 20 moves the battery holder 22 outward, increasing the distance between the spring contact 90 and the contact terminals 82 of the motor 74 so that the battery terminals 84, 88 cannot simultaneously contact the spring contact 90 and the contact terminals 82.

The batteries 86 are removed for replacement by further depressing the sliding actuator 20, so that the second latching surface 104 is moved out of contact with the slot surface 98, and by removing the battery holder 22, along with the batteries 86, in the direction opposite arrow 94. New batteries 86 are then inserted in the battery holder 22, which is moved inward, in the direction of arrow 94, to be latched in place by the second latching surface 104 with the motor 74 off or by the first latching surface 96 with the motor on.

Figure 12:
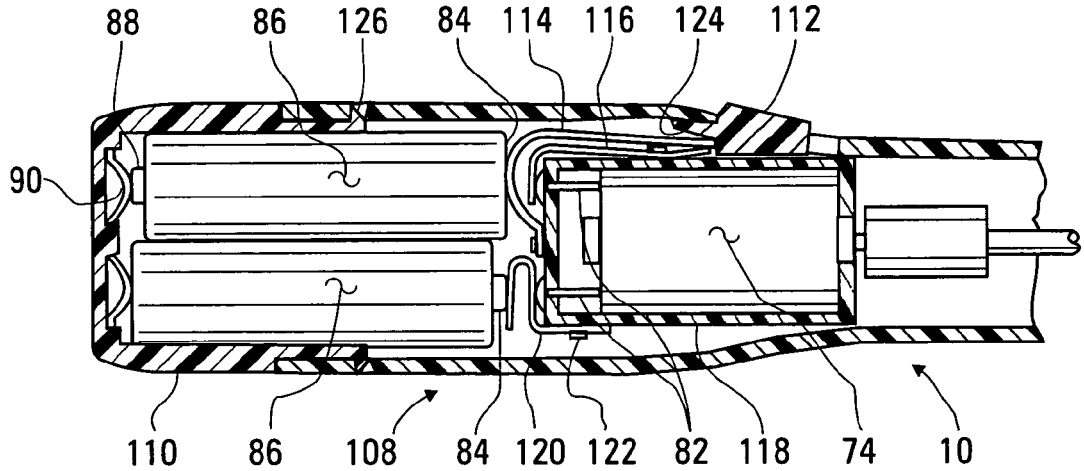
FIG. 12 is a fragmentary cross-sectional bottom plan view of a version of the appliance of FIG. 1 having alternative structures associated with a motor and batteries therein.

FIG. 12 is a fragmentary bottom plan view of the appliance 10 that is similar to FIG. 11, except that an alternative structure 108 is shown for holding the batteries 86 and for switching electrical power to the motor 74. Similar or identical elements are accorded similar reference numbers. In the alternative structure 108, the batteries 86 are held stationary by an alternative battery holder 110, and an alternative slicing actuator 112 is moved to open and close a pair of spring contacts 114, 116. An alternative motor housing 118 holds a pair of spring terminals 114, 120 against the distal end terminals 84 of the batteries 86, with the proximal end terminals 88 of the batteries 86 being held against the spring contact 90. The spring terminal 120 additionally contacts one of the motor terminals 82. The alternative motor housing 118 also holds the spring contact 116 against the other motor terminal 82. For example, these spring contacts 114, 116, 120 are each fastened to the alternative motor housing 118 by heat forming studs 122 extending through holes in the contacts.

When the sliding actuator 112 is in the position shown, an inclined actuation surface 124 of the sliding actuator 112 holds the spring contacts 114, 116 together so that an electrical circuit is closed, causing the motor 74 to run. When the sliding actuator 112 is moved inward, in the direction of arrow 94, the movement of the inclined actuation surface 124 away from the spring contacts 114, 116, allows these contacts 114, 116 to open, so that the motor 74 is turned off.

The batteries 86 may be removed for replacement by simultaneously depressing latching tabs 126 and by removing the alternative battery holder 110, with the batteries 86, in the direction opposite arrow 94.

Referring again to FIG. 7, the pad 16 may be composed of a porous material that can absorb and release a lotion, such as an open-cell elastomeric foam resin or a natural or synthetic sponge material.

Figure 13:
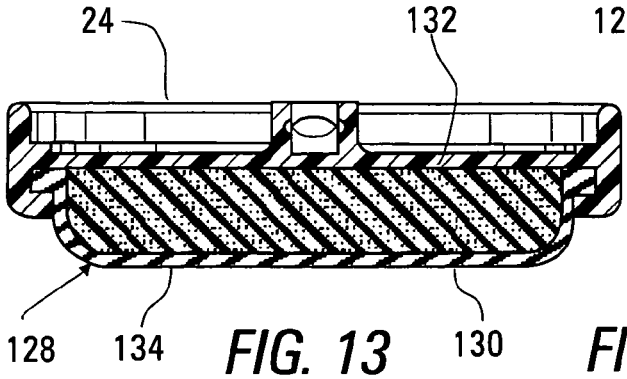
FIG. 13 is a cross-sectional elevation of a pad mounting plate, for use in the appliance of FIG. 1, including an alternative pad having an outer layer composed of a solid elastomeric resin and a core composed of an elastomeric foam resin.

FIG. 13 is a cross-sectional elevation of the pad mounting plate 24 holding an alternative pad 128 that includes an outer layer 130 composed of a solid elastomeric resin and a core 132 composed of an elastomeric foam resin. Alternatively, the pad 128 may be sufficiently rigid to extend around an air space. For example, the outer layer 130 may be composed of a silicone rubber. Preferably, the outer layer 130 has an external surface 134 with a texture providing pockets holding lotion or providing ridges or bumps allowing lotion to be held on intervening surfaces.

Figure 14:
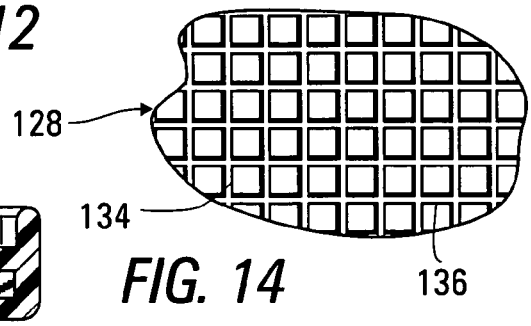
FIG. 14 is a fragmentary bottom plan view of a version of the alternative pad of FIG. 13 having an external surface including a number of grooves.

FIG. 14 is a fragmentary bottom plan view of an alternative pad 128 having an external surface 134 including a number of grooves 136 holding lotion during the process of its application.

Figure 15:
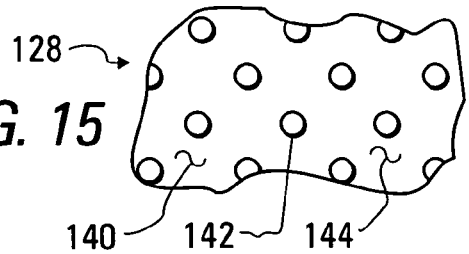
FIG. 15 is a fragmentary bottom plan view of a version of the alternative pad of FIG. 13 having an external surface including a number of bumps.

FIG. 15 is a fragmentary bottom plan view of an alternative pad 128 having an external surface 140 with a number of bumps allowing lotion to be held on the intervening portions 144 of the surface 140.

While the invention has been described in its preferred versions with some degree of particularity, it is understood that this description has been given only by way of example, and that many variations can be made without departing from the spirit and scope of the invention, as described in the appended claims.

What is claimed is:

1. An appliance for applying lotion to the skin, wherein the appliance comprises:

a housing;

a soft pad, mounted within the housing to rotate about an axis of rotation, including a flat application surface, outwardly disposed from the housing, extending perpendicularly to the direction of rotation;

an elongated handle extending from the housing in a direction perpendicular to the direction of rotation;

a motor driving the soft pad to rotate about the axis of rotation; and a first battery supplying electrical power to drive the motor;

an axle shaft mounted to rotate within the housing about the axis of rotation, wherein the axle shaft includes a detent member held outward from the axle shaft by a spring;

a mounting plate attached to the soft pad, wherein the soft pad is mounted to rotate about the axis of rotation by releasably attaching the mounting plate to the axle shaft by the detent member engaging a groove within the mounting plate to releasably attach the mounting plate to the axle shaft;

an actuator movable between a first position, in which an electrical circuit extending between the first battery and the motor is closed, and a second position, in which the electrical circuit is opened wherein the actuator includes a first latching surface engaged to hold the actuator in the first position and a second latching surface engaged to hold the actuator in the second position, and wherein the actuator is depressed to disengage the first and second latching surfaces, allowing movement of the actuator between the first and second positions;

a battery holder, holding the first battery, wherein the actuator is attached to the battery holder; and a first motor terminal, electrically connected to the motor, wherein an end of the first battery is held against the first motor terminal with the actuator in the first position, and wherein the first battery is moved away from the motor terminal as the actuator is moved into the second position.

2. The appliance of claim 1, additionally comprising:

a second battery held within the battery holder;

a second motor terminal, electrically connected to the motor, wherein an end of the second battery is held against the second motor terminal with the actuator in the first position; and a contact spring within the battery holder electrically connecting ends of said first and second batteries remote from the first and second motor terminals.

3. The appliance of claim 2, wherein the battery holder extends within the elongated handle from an external end of the elongated handle, and the actuator is depressed to release the battery holder from the elongated handle for removal from the elongated handle.

4. The appliance of claim 2, wherein the battery holder extends within an elongated handle from an external end of the elongated handle, and the actuator is depressed to release the battery holder from the elongated handle for removal from the elongated handle.

5. An appliance for applying lotion to the skin, wherein the appliance comprises:

a housing;

a soft pad, mounted within the housing to rotate about an axis of rotation, including a flat application surface, outwardly disposed from the housing, extending perpendicularly to the direction of rotation;

an elongated handle extending from the housing in a direction perpendicular to the direction of rotation;

a motor driving the soft pad to rotate about the axis of rotation; and a first battery supplying electrical power to drive the motor;

an actuator movable between a first position, in which an electrical circuit extending between the first battery and the motor is closed, and a second position, in which the electrical circuit is opened wherein the actuator includes a first latching surface engaged to hold the actuator in the first position and a second latching surface engaged to hold the actuator in the second position, and wherein the actuator is depressed to disengage the first and second latching surfaces, allowing movement of the actuator between the first and second positions;

a battery holder, holding the first battery, wherein the actuator is attached to the battery holder; and a first motor terminal, electrically connected to the motor, wherein an end of the first battery is held against the first motor terminal with the actuator in the first position, and wherein the first battery is moved away from the motor terminal as the actuator is moved into the second position.

6. The appliance of claim 5, additionally comprising:

a second battery held within the battery holder;

a second motor terminal, electrically connected to the motor, wherein an end of the second battery is held against the second motor terminal with the actuator in the first position; and a contact spring within the battery holder electrically connecting ends of said first and second batteries remote from the first and second motor terminals.

* * * * *